US005740739A

United States Patent [19]

Herold et al.

[11] Patent Number: 5,740,739

[45] Date of Patent: Apr. 21, 1998

[54] METHOD AND DEVICE FOR WASHING A FORM CYLINDER AND AN ASSOCIATED APPLICATOR ROLLER IN A PRINTING MACHINE

[75] Inventors: Manfred Herold, Hainburg; Georg Hartung, Seligenstadt; Ulrich Jung, Limburg, all of Germany

[73] Assignee: MAN Roland Druckmaschinen AG, Germany

[21] Appl. No.: 684,154

[22] Filed: Jul. 19, 1996

[30] Foreign Application Priority Data

Jul. 20, 1995 [DE] Germany ..... 195 26 574.2

[51] Int. Cl.[6] ..... B41F 35/02

[52] U.S. Cl. ..... 101/425; 101/424

[58] Field of Search ..... 101/425, 424, 101/423

[56] References Cited

U.S. PATENT DOCUMENTS

| | | | |
|---|---|---|---|
| 1,378,278 | 5/1921 | Roberts | 101/425 |
| 1,703,015 | 2/1929 | Ratignier | 101/425 |
| 4,870,900 | 10/1989 | Robertson | 101/425 |
| 4,905,596 | 3/1990 | Kobler | 101/216 |
| 5,367,982 | 11/1994 | DeMoore et al. | 101/425 |
| 5,438,923 | 8/1995 | Schoeps | 101/425 |

FOREIGN PATENT DOCUMENTS

| | | | |
|---|---|---|---|
| 18224 | of 1913 | United Kingdom | 101/425 |
| WO 95/01876 | 1/1995 | WIPO . | |

*Primary Examiner*—Edgar S. Burr
*Assistant Examiner*—Leslie Grohusky
*Attorney, Agent, or Firm*—Leydig, Voit & Mayer, Ltd.

[57] ABSTRACT

A method and apparatus for washing printing press form cylinders and associated applicator rollers in a manner which reduces the drying of quick-drying media, such as varnish or ink, on the applicator roller and form cylinder. The washing device is disposed in a nip between the form cylinder and applicator roller and has two curved surfaces disposed in closely adjacent relation to respective surfaces of the form cylinder and applicator roller. Each curved surface has a spray device for directing a cleaning fluid onto the adjacent form cylinder and applicator roller and a suction-extraction device for removing sprayed cleaning fluid and removed ink and impurities. The method and apparatus may be selectively operated in a print-on mode in which a cleaning fluid is sprayed onto the rotating form cylinder and is suction-extracted from its outer surface. When printing is switched off, the method and apparatus may be operated in a print-off mode in which cleaning fluid is sprayed onto the rotating applicator roller and onto the rotating form cylinder, with the applicator roller is separated from the form cylinder.

18 Claims, 1 Drawing Sheet

METHOD AND DEVICE FOR WASHING A FORM CYLINDER AND AN ASSOCIATED APPLICATOR ROLLER IN A PRINTING MACHINE

BACKGROUND OF THE INVENTION

1. Field of the Invention

The present invention relates generally to a method and apparatus for cleaning printing cylinders, and more particularly, to a method and apparatus for cleaning the form cylinder and associated applicator roller in a printing unit of an offset printing machine. The invention has particular utility in connection with the cleaning of the form and applicator rollers of varnishing units of a printing machine.

2. Discussion of the Related Art

A cleaning device for printing cylinders is shown in WO95/01876. The cleaning device is movable parallel to the axis of the cylinder to be cleaned and can be operated with a cleaning medium in the form of compressed air, optionally with granular additives, or in the form of a cleaning fluid, optionally with granular additives. The device is adapted to spray the cleaning medium onto the cylinder to be cleaned and to remove the cleaning medium and discharged impurities and ink from the cylinder by means of suction extraction. When granular additives are used, the surface of the cylinder can be adversely influenced.

SUMMARY OF THE INVENTION

It is an object of the present invention to provide an improved method and apparatus for cleaning both the form cylinder and associated applicator roller in a printing unit.

Another object is to provide a method and apparatus as characterized above in which the form cylinder and applicator roller of the printing unit can be selectively cleaned simultaneously or individually.

A further object is to provide a method and apparatus of the foregoing type which minimizes the drying of quick-drying liquid media, such as varnish or ink, on the applicator roller or form cylinder.

The foregoing objects are achieved by an apparatus which allows for the combined or individual washing of the form cylinder with a clamped-on printing form and an applicator roller such as a screened applicator roller used in a varnishing unit. The cleaning device is particularly adapted for preventing undesirable "clogging" of wells of the screened applicator roller. The invention allows for the automated washing of the applicator roller and form cylinder of the printing unit in varying operating modes, and the cleaning times are shortened as a result of the combined washing. Preferably water is used as a cleaning agent, and alternatively, solvents which contain water can be used.

Other objects and advantages of the invention will become apparent upon reading the following detailed description and upon reference to the drawing, in which:

Figure 1:
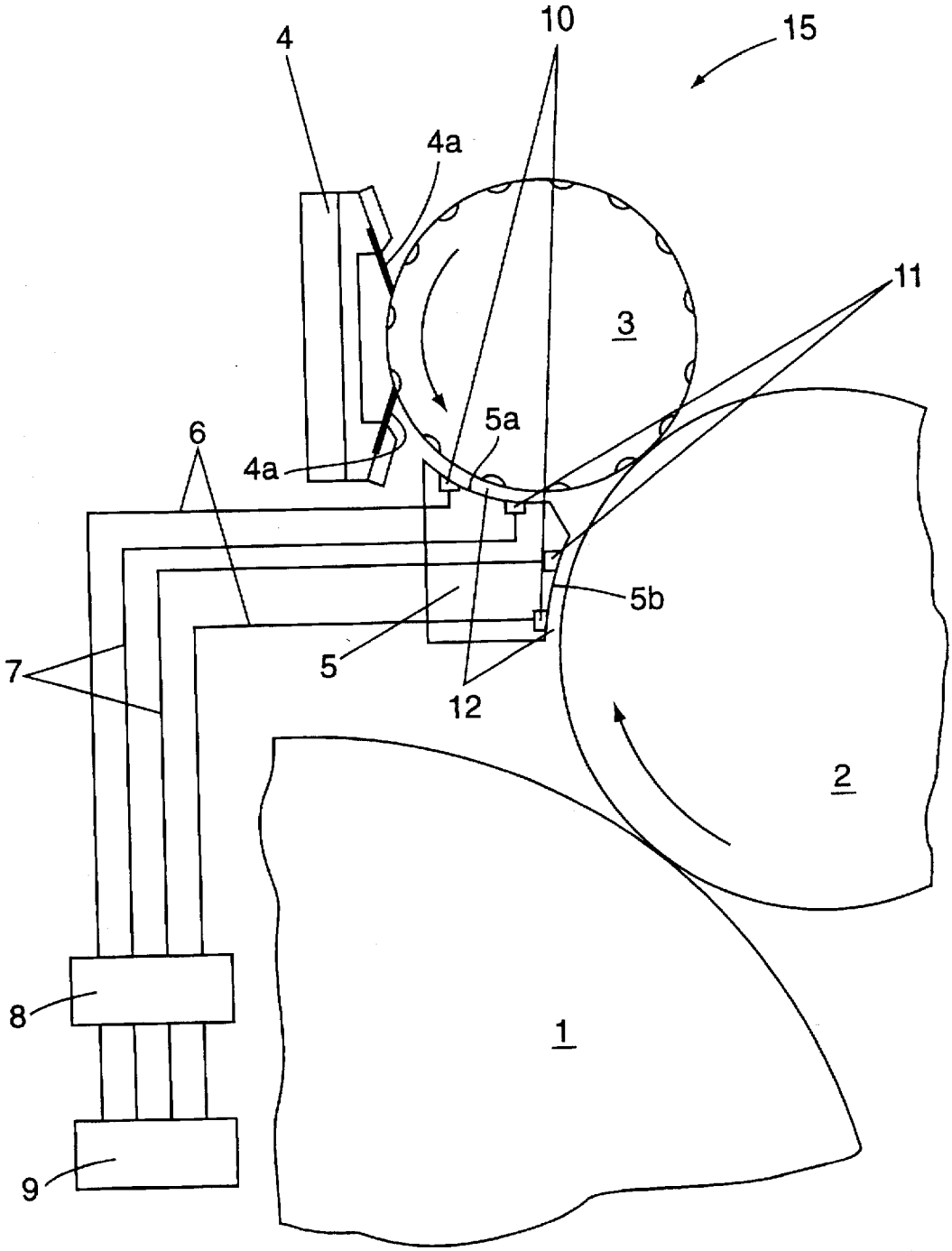
FIG. 1 is a partially diagrammatic side elevational view of an illustrated printing unit having a washing device in accordance with the present invention.

While the invention is susceptible of various modifications and alternative constructions, a certain illustrated embodiment thereof has been shown in the drawings and will be described below in detail. It should be understood, however, that there is no intention to limit the invention to the specific form disclosed, but on the contrary, the intention is to cover all modifications, alternative constructions and equivalents falling within the spirit and scope of the invention.

DETAILED DESCRIPTION OF THE DRAWING

Referring now more particularly to the drawing, there is shown an illustrative printing unit 15 of an offset printing machine. The printing unit 15 in this instance is a varnishing unit typically located after the last ink transfer printing unit in the running direction of the printing press for providing in-line varnishing of printed materials directed through the press. The printing unit 15 in this case consists of an impression cylinder 1 which guides printed material and which has a throw-on and throw-off form cylinder 2. The form cylinder 2 carries a letterpress form which is produced essentially from a flexible elastomer. The form cylinder 2 in turn has a throw-on and throw-off applicator roller 3, which has a screen-well structure and preferably is made of ceramic. A liquid medium feed device 4 in the illustrated embodiment is a chamber type doctor device having a pair of doctor blades **4*a* disposed adjacent the applicator roller and is moveable between throw on and throw off positions with respect to the applicator roller 3. The liquid medium feed device 4 has an conventional conduit system for feeding and discharging liquid medium to and from the feed device. While in the illustrated embodiment, varnish is supplied to the feed device 4, it will be understood that alternatively ink may be supplied. It also will be understood by one skilled in the art that the impressions cylinder 1, form cylinder 2, applicator roller 3, and liquid medium feed device 4 may be mounted in the side stands of a printing press frame and the form cylinder 2, applicator 3, and the feed device 4**, may be moveable between throw on and throw off positions in a known way.

For cleaning the form cylinder 2 and applicator roller 3, a washing device 5 is provided. The washing device 5 is movable in a direction parallel to the axes of the form cylinder 2 and applicator roller 3 by appropriate means, such a cross-member fixed between the side stands of the printing machine frame.

In accordance with the invention, the washing device is located in a nip between the form cylinder and applicator roller has a pair of curve surfaces disposed in closely spaced relation to outer surfaces of the form cylinder 2 and applicator roller 3 so as to enable the cleaning device to individually or simultaneously direct and remove cleaning fluids from the surfaces of the form cylinder and applicator roller. In the illustrated embodiment, the washing device 2 has two curved surfaces **5*a*, 5*b* which preferably extend concentrically relative to the outer surfaces of the form cylinder 2 and applicator roller 3 when in their thrown-on or operating positions. Each surface, 5*a*, 5*b* has a spray device 10 which is followed in the direction of rotation of the applicator roller 3 or form cylinder 2 by a suction extraction device 11. The spray devices 10 each are connected to a respective cleaning fluid feed 6, and the suction extractor devices 11 each are connected to a respective cleaning fluid discharge 7. The cleaning fluid feeds 6 and the cleaning fluid discharges 7 terminate in a common reservoir 9 which receives cleaning fluid from the discharges 7 and supplies cleaning fluid to the cleaning fluid feeds 6** in a continuous circulating system. When a plurality of cleaning fluids are to be used, for example, the solvents with water, or water alone, it will be understood that a plurality of reservoirs can be incorporated into the circulation system.

For controlling operation of the spray devices 10 and suction extraction devices 11, an appropriate control unit 8 may be provided which is integrated into the circuitry for operating suction pumps and the like for the cleaning fluid feeds 6 and the cleaning fluid discharges 7. By virtue of such control unit 8, the operation of the washing device may be selectively operated in either a "print-on mode" (during which time materials to be printed are directed through the printing machine) and in a "print off mode" (during which time the transfer of materials through the printing machine is interrupted) for cleaning the form cylinder and applicator roller simultaneously or individually.

In the printing mode of operation, the liquid medium, which is varnish when the unit 15 is operated as a varnish unit, is fed to the screened applicator roller 3 by the feed device 4. The applicator roller 3 transfers the varnish in a metered manner onto the form cylinder 2 which finishes the printing material being directed through the printing machine in conjunction with the impression cylinder 1. While the form cylinder 2 is conveying varnish, cleaning fluid is sprayed onto the form cylinder 2 in pulses in a controlled manner by means of the spray device 10 in the curved section **5*b* and is suction-extracted continuously by means of the suction-extracted device 11. At the same time, the washing device 5 is moved axially back and forth parallel to the form cylinder 2. In the print-on mode of operation, the surface 5*a* of the washing device 5 adjacent to the applicator roller 3** is not activated.

In the print-off operating mode, the form cylinder 2 is uncoupled from the applicator roller 3. The cleaning fluid is sprayed in pulses in a controlled manner onto the form cylinder 2 and the applicator roller 3 by the spray devices 10 in the curved sections **5*a* and 5*b* and is suction-extracted continuously from the outer surface of the form cylinder 2 and of the applicator roller 3. At the same time, in the print-off mode, varnish can still be fed continuously to the rotating applicator roller 3, while its outer surface is being washed. Alternatively, in the print-off mode, the feed of varnish onto the applicator roller 3 can be stopped while its outer surface is being washed. The form cylinder 2 can optionally also be washed at the same time. The applicator roller 3 can continue to be washed separately by stopping the form cylinder or using it for other work and separating it from the applicator roller 3. The cleaning fluid is then sprayed solely onto the rotating applicator roller and suction-extracted from the outer surface of the latter. The form cylinder 2** is then ready, for example, for a change of printing form. Preferably, the varnishing unit is washed synchronously with preceding printing units and/or further varnishing units of the printing machine, but separate washing of the varnishing unit is also possible.

From the foregoing, it can be seen that the method and apparatus of the present invention are adapted for simultaneously or individually cleaning the form and applicator rollers in printing units in a controlled manner which minimizes the drying of quick-drying liquid media, such as varnish or ink, on the applicator roller and formed cylinder.

What is claimed is:

1. A printing unit of a printing machine comprising a rotatable form cylinder, a rotatable applicator roller in adjacent parallel relation to said form cylinder, a liquid medium feed device for feeding a liquid medium to said applicator roller, a washing device mounted for movement parallel to axes of said form cylinder and applicator roller, said washing device having a cleaning fluid feed, a cleaning fluid discharge and a first curved surface in closely spaced adjacent relation to said form cylinder and a second curved surface in closely spaced adjacent relation to said applicator roller, said washing device having a spray device and a suction extractor device disposed at each said curved surface, said spray devices each being connected to the respective cleaning fluid feed and said suction extractor devices each being connected to the respective cleaning fluid discharge, said spray devices being operable for discharging cleaning fluid received from the respective cleaning fluid feed onto the adjacent form cylinder and applicator roller, said suction extractor devices being operable for removing cleaning fluid from the respective adjacent form cylinder and applicator roller and directing it to the respective cleaning fluid discharge, and a control for individually operating the spray devices and suction extractor devices of each curved surface.

2. The printing unit of claim 1 in which said washing device is disposed in a nip between said form cylinder and applicator roller.

3. The printing unit of claim 1 in which each said cleaning fluid feed and cleaning fluid discharge are connected to a common reservoir from which cleaning fluid is supplied to the respective cleaning fluid feeds for said spray devices and into which cleaning fluid extracted by said suction extraction devices is discharged.

4. The printing unit of claim 1 in which each spray device is located in preceding relation to the suction extraction device in the respective curved surface in the direction of rotation of the respective adjacent applicator roller and form cylinder.

5. The printing unit of claim 1 including a supply of varnish, and said liquid medium feed device is operable for feeding varnish from said supply to said applicator roller.

6. The printing unit of claim 1 including a supply of ink, and said liquid medium feed device is operable for feeding ink from said supply to said applicator roller.

7. The printing unit of claim 1 in which said applicator roller is a screened roller.

8. The printing unit of claim 1 in which the liquid medium feed device is a chamber-type doctor device movable between a thrown-off position removed from the applicator roller and a thrown-on position in operative adjacent relation to the applicator roller.

9. The printing unit of claim 1 in which each cleaning fluid feed is operable for directing a water containing cleaning fluid to the respective spray device.

10. The printing unit of claim 1 in which each cleaning fluid feed is operable for directing water to the respective spray device.

11. The printing unit of claim 1 in which said form cylinder carries a letter press form.

12. A method for washing a rotating form cylinder and an associated adjacent rotating applicator roller in a printing unit which can be operated in a print-on mode during which materials are directed through the printing unit and a print-off mode during which the transfer of materials through the printing unit is interrupted comprising during the print-on mode feeding a liquid medium to the applicator roller, spraying a cleaning fluid onto the rotating form cylinder, and by suction extraction removing cleaning fluid from the form cylinder that has been sprayed thereon, and during the print-off mode spraying a cleaning fluid onto the rotating applicator roller, by suction extraction removing cleaning fluid from the applicator roller that is sprayed thereon, separately spraying cleaning fluid onto the rotating form cylinder, and by suction extraction removing cleaning fluid from the form cylinder that has been sprayed thereon, and selectively controlling the operation of the print-off and print-on operating modes.

13. The method of claim 12 in which the liquid medium fed to the applicator roller is varnish.

14. The method of claim 12 in which the liquid medium fed to applicator roller is ink.

15. The method of claim 12 including continuously feeding liquid medium to the rotating applicator roller during the print-off mode.

16. The method of claim 12 including stopping the feed of liquid medium to the rotating applicator roller during the print-off mode of operation.

17. The method of claim 12 including stopping the spraying of cleaning fluid onto the applicator roller during the print-on mode.

18. The method of claim 12 including separating the applicator roller and form cylinder during the print-off mode.

* * * * *